US008011031B2

(12) United States Patent
Campbell et al.

(10) Patent No.: US 8,011,031 B2
(45) Date of Patent: Sep. 6, 2011

(54) QUIET, LOW WATER VOLUME TOILET

(75) Inventors: Charles O. Campbell, Santa Rosa, CA (US); William E. Wood, Ukiah, CA (US)

(73) Assignee: Wabtec Holding Corp., Wilmerding, PA (US)

( * ) Notice: Subject to any disclaimer, the term of this patent is extended or adjusted under 35 U.S.C. 154(b) by 643 days.

(21) Appl. No.: 12/135,510

(22) Filed: Jun. 9, 2008

(65) Prior Publication Data

US 2009/0007323 A1 Jan. 8, 2009

Related U.S. Application Data

(63) Continuation-in-part of application No. 11/013,612, filed on Dec. 16, 2004, now Pat. No. 7,383,593.

(51) Int. Cl.
*E03D 9/10* (2006.01)

(52) U.S. Cl. ..... 4/319; 4/425

(58) Field of Classification Search ..... 4/300, 421–422, 4/425, 319

See application file for complete search history.

(56) References Cited

U.S. PATENT DOCUMENTS 4,550,452 A 11/1985 Tufts
4,578,831 A 4/1986 Mellinger et al.
5,133,089 A * 7/1992 Tsutsui et al. ..... 4/300
5,502,845 A 4/1996 Hayashi et al.
5,803,114 A 9/1998 Johnson
5,918,325 A 7/1999 Arita et al.
5,983,413 A 11/1999 Hayashi et al.
6,029,287 A 2/2000 Ge et al.
6,357,056 B2 3/2002 Jermier
6,421,843 B1 7/2002 Mellinger et al.
6,470,505 B1 10/2002 Boisvert
6,651,266 B1 * 11/2003 Liu et al. ..... 4/425
2007/0113331 A1 * 5/2007 Prokopenko et al. ..... 4/425
2008/0060121 A1 * 3/2008 Andreiu ..... 4/300

* cited by examiner

*Primary Examiner* — Charles Phillips
(74) *Attorney, Agent, or Firm* — The Webb Law Firm

(57) ABSTRACT

A toilet assembly is provided having a bowl assembly having an inlet, a wastewater outlet, and a water supply inlet having an inlet valve. The assembly includes an adjustable metering valve in fluid communication with the inlet valve and the inlet of the bowl assembly, and an accumulator in fluid communication with the inlet valve and disposed upstream of the adjustable metering valve. A fragmentation passage is provided in fluid communication with the wastewater outlet and disposed downstream of the wastewater outlet. The assembly includes jet assembly having an inlet in fluid communication with the inlet valve, and an outlet disposed upstream of the fragmentation passage. The water supply inlet is structured to deliver a quantity of water through the inlet of the bowl assembly, and a quantity of water to the jet assembly to remove wastewater from the fragmentation passage.

20 Claims, 5 Drawing Sheets

QUIET, LOW WATER VOLUME TOILET

CROSS-REFERENCE TO RELATED APPLICATION

The present application claims priority to, and is a continuation-in-part of, U.S. application Ser. No. 11/013,612 entitled "Quiet, Low Water Volume Toilet" filed Dec. 16, 2004, the entire disclosure of which is herein incorporated by reference.

BACKGROUND OF THE INVENTION

1. Field of the Invention

This present invention relates to low water volume toilets and, more specifically, to a quiet, low water volume toilet.

2. Background Information

Low water volume toilets are needed in locations that have a limited supply of water, such as trains, aircraft, ships, and in dry climates. To reduce the volume of water required per flush, toilets have utilized complex bowl and water channel patterns as well as high pressure water. Each of these designs has their disadvantages. For example, the complex bowl shapes are difficult to create molds for and tend to be larger and/or heavier than less complex shapes. The high pressure systems create a loud noise when flushed. That is, the high pressure water is typically injected into a macerator at the base of the toilet bowl. The water jet creates a loud noise as it exits the water supply line and enters the macerator. Additionally, both designs are known to back up and flood what is typically a small rest room e.g., the rest room on a vehicle. Further, it is desirable to have a smaller toilet that has a reduced number of connections between the toilet assembly and the facility in which it is disposed and a reduced number of parts.

Therefore, there is a need for a low volume toilet assembly that is quiet.

There is a further need for a low volume toilet assembly having a reduced number of connections between the toilet assembly and the facility in which it is disposed and a reduced number of parts.

There is a further need for a low volume toilet assembly that may be disposed in existing facilities.

SUMMARY OF THE INVENTION

In one embodiment of the present invention, a toilet assembly includes a bowl assembly having an inlet and a wastewater outlet, and a water supply inlet having an inlet valve. The toilet assembly also includes an adjustable metering valve in fluid communication with the inlet valve and the inlet of the bowl assembly, and an accumulator in fluid communication with the inlet valve and disposed upstream of the adjustable metering valve. The toilet assembly further includes a fragmentation passage in fluid communication with the wastewater outlet and disposed downstream of the wastewater outlet. A jet assembly is also provided having an inlet and an outlet, with the inlet in fluid communication with the inlet valve and the outlet disposed upstream of the fragmentation passage. The water supply inlet is structured to deliver a quantity of water through the inlet of the bowl assembly and to deliver a quantity of water to the jet assembly to remove wastewater from the fragmentation passage.

The adjustable metering valve may be disposed downstream of the inlet valve and upstream of the bowl assembly inlet. Optionally, the adjustable metering valve is a ball valve. In one configuration, when the inlet valve is moved to an open position, the water may be directed from the inlet valve to the jet assembly and the adjustable metering valve which meters fluid flow into the bowl assembly. When the adjustable metering valve is moved to a closed position, the water may be directed from the inlet valve to the jet assembly without entering the adjustable metering valve or the bowl assembly inlet. The adjustable metering valve may generate a pressure differential which compresses air in the accumulator, and movement of the inlet valve to a closed position may release pressurized water caused by the pressure differential of the adjustable metering valve on the accumulator.

In another configuration, the toilet assembly may include a one-way check valve and an accumulator in fluid communication with the inlet valve and disposed between the inlet valve and the adjustable metering valve. The accumulator may be disposed downstream of the one-way check valve and upstream of the adjustable metering valve. When the inlet valve is moved to an open position, the adjustable metering valve may generate a pressure differential which compresses air in the accumulator and during this process, water is retained under pressure in the accumulator. When the inlet valve is moved to a closed position, the pressure differential is eliminated. The one-way check valve may limit movement of the water stored in the accumulator and cause water to flow through the adjustable metering valve and into the bowl assembly. When the adjustable metering valve is moved to a closed position, the water may be directed from the inlet valve to the jet assembly without entering the adjustable metering valve. When the adjustable metering valve is moved to a closed position, the water may be directed from the inlet valve to the jet assembly without entering the accumulator.

The water system of the present invention may be structured to deliver a quantity of water to the bowl assembly and to deliver a quantity of water to the jet assembly at mutually exclusive intervals. Optionally, the water system may be directed to deliver a quantity of water to either the bowl assembly or the jet assembly by a switch. The direction of the quantity of water to the bowl assembly or the jet assembly may be determined by the amount of waste present in the bowl assembly. In one configuration, the water system may deliver about 2 quarts of water to the bowl assembly, and about 1 quart of water to the jet assembly. The switch may control the length of time the inlet valve is in an open position, and may be an electrical, mechanical, hydraulic, or pneumatic switch. In one configuration, multiple switches may be used to control the length of time the inlet valve is in an open position. Optionally, the switch is a manual switch and the length of time the inlet valve is in the open position is controlled solely by an operator.

In another embodiment of the present invention, a method of generating a two-stage flushing action includes the step of providing a toilet assembly. The toilet assembly includes a bowl assembly having an inlet and a wastewater outlet, and a water supply inlet having an inlet valve. The toilet assembly also includes an adjustable metering valve in fluid communication with the inlet valve and the inlet of the bowl assembly, and an accumulator in fluid communication with the inlet valve and disposed upstream of the adjustable metering valve. The toilet assembly further includes a fragmentation passage in fluid communication with the wastewater outlet and disposed downstream of the wastewater outlet. A jet assembly is also provided having an inlet and an outlet, with the inlet in fluid communication with the inlet valve and the outlet disposed upstream of the fragmentation passage. The water supply inlet is structured to deliver a quantity of water through the inlet of the bowl assembly and to deliver a quantity of water to the jet assembly to remove wastewater from the fragmentation passage. The method of generating a two-stage flushing action further includes the step of selectively directing a quantity of water to the inlet of the bowl assembly or to the jet assembly based on the amount of waste present in the bowl assembly.

In another configuration, the water system delivers about 2 quarts of water to the bowl assembly, and about 1 quart of water to the jet assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
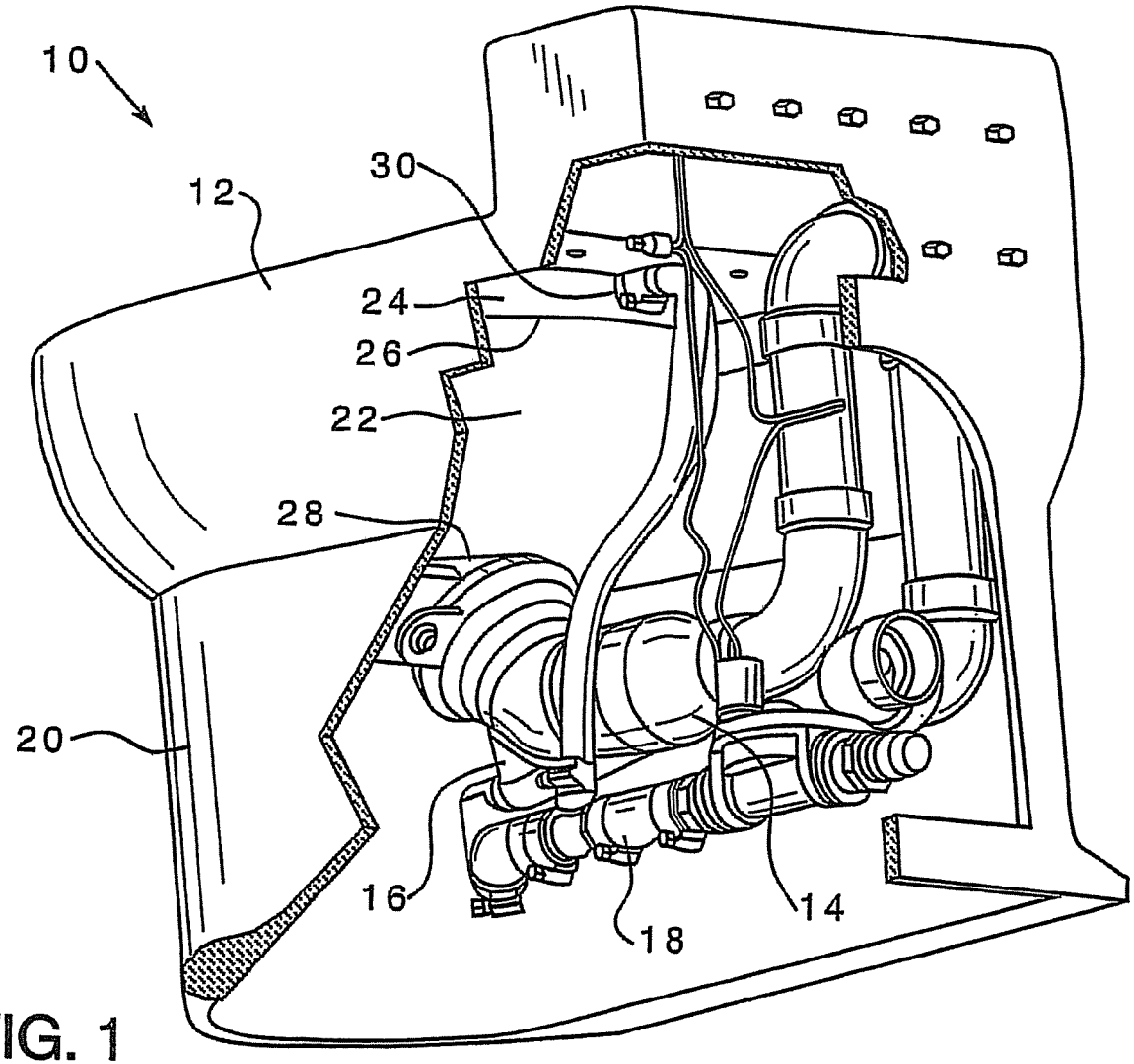
FIG. 1 is a cut away isometric view of the low volume toilet assembly of the present invention.

As shown in FIG. 1, low volume toilet assembly 10 includes a bowl assembly 12, a fragmentation passage 14, a jet assembly 16, and a water system 18. The bowl assembly 12 includes a housing assembly 20, a bowl 22, and a rim 24. The housing assembly 20 is structured to enclose and support the internal components, described below. The bowl 22 is coupled to the housing assembly 20 and includes an upper edge 26 and a lower wastewater outlet 28. The rim 24 is disposed about the bowl upper edge 26. The rim 24 includes a wastewater inlet 30. The rim 24 is in fluid communication with the wastewater inlet 30 and the bowl 22. The rim 24 is structured to distribute a flow of water about the upper edge 26 of the bowl 22 so that, as the water descends into the bowl 22, substantially all of the upper surface of the bowl 22 is washed with water. The wastewater outlet 28 is in fluid communication with the fragmentation passage 14.

Figure 2:
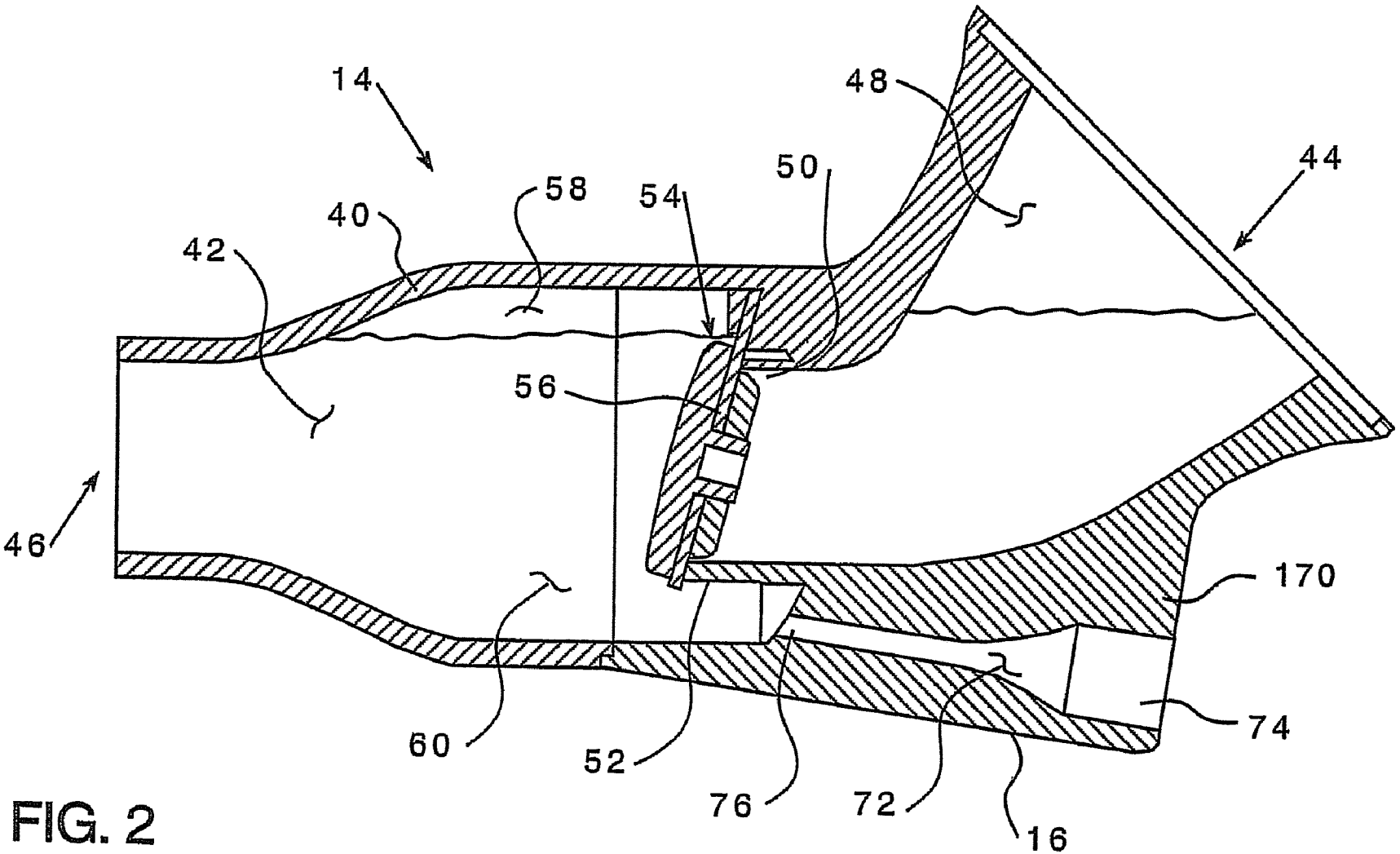
FIG. 2 is a cross-sectional view of the fragmentation passage and jet assembly of the present invention.

The fragmentation passage 14, shown in FIG. 2, includes a body 40 defining a passage 42, an inlet 44, and an outlet 46. Both the fragmentation inlet 44 and fragmentation outlet 46 are in fluid communication with the passage 42. The fragmentation inlet 44 is, generally a passage 48 within the fragmentation passage body 40. The passage 48, preferably, terminates in the passage 42 with an upper edge 50 that terminates upstream of a lower edge 52. That is, the mouth of the fragmentation inlet 44 at the passage 42 is tilted with the upper edge 50 more upstream than the lower edge 52. Within the passage 42 is an anti-backup valve 54. The anti-backup valve 54 is structured to move between a first, closed position, wherein the anti-backup valve blocks the passage of fluid between the fragmentation inlet 44 and the fragmentation outlet 46, and a second, open position, wherein the anti-backup valve 54 allows fluid to pass between the fragmentation inlet 44 and the fragmentation outlet 46. The anti-backup valve 54 is a generally flat member 56 disposed at the mouth of the fragmentation inlet 44 within the passage 42. The anti-backup valve 54 is coupled to the passage upper edge 50. By virtue of the mouth of the fragmentation inlet 44 at the passage 42 being tilted, the weight of the anti-backup valve 54 will bias the lower portion of the valve member 56 against the passage lower edge 52. Thus, the anti-backup valve 54 is biased in the first, closed position. Alternatively, the anti-backup valve 54 may also have an additional biasing device, such as, but not limited to, a spring (not shown) structured to bias the anti-backup valve 54 in the first, closed position. The passage 42, as described below, is typically filled with water. As such, there is an upper portion 58 that is disposed above the waterline, and a lower portion 60 that is disposed below the waterline.

The jet assembly 16 is structured to introduce a stream of high pressure water into the passage 42 at a location below the water line and generally adjacent to the anti-backup valve 54. The jet assembly 16 includes a body 70 that defines a passage 72. The passage 72 has a first, upstream end 74 and a second, downstream end 76. The passage first upstream end 74 has a first cross-sectional area and the passage second downstream end 76 has a second cross-sectional area. The second cross-sectional area is smaller than said first cross-sectional area. Thus, the passage 72 is structured to increase the speed of a fluid flowing therethrough. As is known, a fluid moving at a high speed is at a lower pressure than a fluid moving at a lower speed. Thus, the jet assembly 16 is structured to create a low pressure zone within the passage 42 when a fluid is injected into the passage 42 through the jet assembly 16. The low pressure zone is disposed adjacent to, and downstream of, the anti-backup valve 54. The jet assembly 16 is structured to create a low pressure zone that has a sufficiently low pressure relative to the pressure upstream of the anti-backup valve 54 to overcome the bias holding the anti-backup valve 54 in the first, closed position. Additionally, as is known in the art, the configuration of the passage 72, as described above is structured to cause a stream of water flowing through the passage 72 to rotate about the longitudinal axis of said passage 72. That is, the passage 72 creates a cyclone effect in the water passing through the passage 72.

Figure 3:
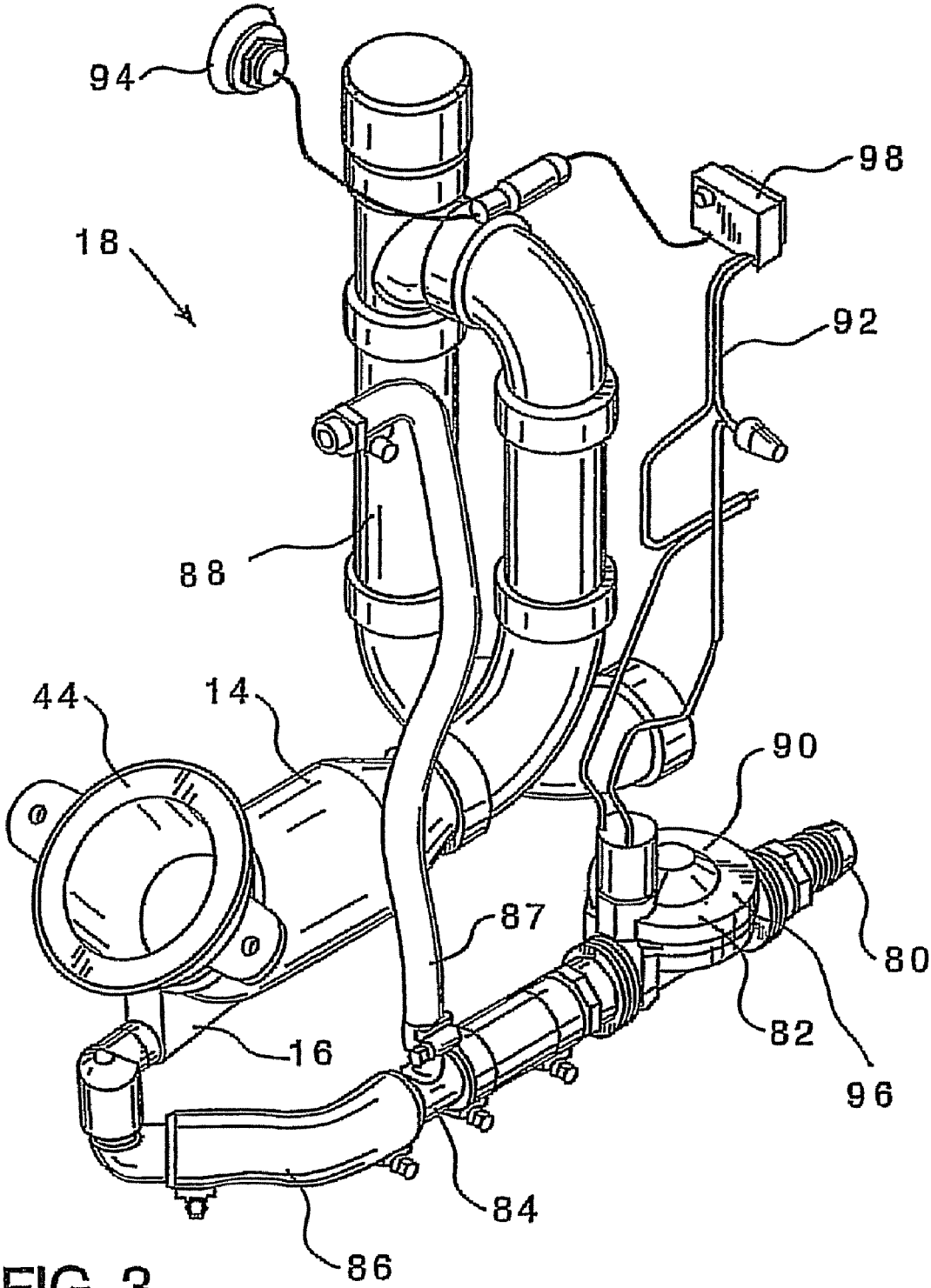
FIG. 3 is an isometric view of the interior components of the low volume toilet assembly of the present invention.

The water system 18 is structured to direct water and wastewater through the toilet assembly 10. Preferably, the water system 18 is structured to use between 1 and 3 quarts per flush, and, more preferably, about 2 quarts of water per flush. As shown in FIG. 3, the water system 18 includes a high pressure water inlet 80, an inlet valve assembly 82, a water flow separator 84, a jet assembly pipe 86, a bowl pipe 87, and an outlet pipe 88. The high pressure water inlet 80 is structured to be coupled in fluid communication with a high pressure water source (not shown) and is in fluid communication with the water flow separator 84. The inlet valve assembly 82 is disposed between the high pressure water inlet 80 and the water flow separator 84. The inlet valve assembly 82 has a valve element (not shown) as is known in the art and which is structured to be moved between a first closed position, wherein water may not flow through the inlet valve assembly 82, and a second, open position, wherein water may flow through the inlet valve assembly 82. The water flow separator 84 is in fluid communication with the jet assembly pipe 86 and the bowl pipe 87. The water flow separator 84 is structured to divide the water into two streams and is, essentially, a manifold. The amount of water directed into either the jet assembly pipe 86 or the bowl pipe 87 is controlled by structures known in the art. For example, the jet assembly pipe 86 and the bowl pipe 87 may have different cross-sectional areas thereby allowing more water to flow into the pipe with the larger cross-sectional area. The jet assembly pipe 86 is in fluid communication with the jet assembly 16, and more specifically, with the jet assembly passage first upstream end 74. The bowl pipe 87 is in fluid communication with the bowl assembly 12, and, more specifically, with the rim wastewater inlet 30. The outlet pipe 88 is coupled to and in fluid communication with the fragmentation outlet 46. The outlet pipe 88 is further structured to be coupled to a wastewater system (not shown) such as, but not limited to, a sewer system or storage tank.

The inlet valve assembly 82 is preferably an electronically actuated valve. That is, the inlet valve assembly 82 includes a solenoid assembly 90, an electrical system 92 having a flush switch 94 and structured to be coupled to a source of electricity (not shown). The solenoid assembly 90 has a solenoid coupled to the valve element and is further coupled to the electrical system 92. The flush switch 94 is mounted on the bowl assembly housing assembly 20. When the flush switch 94 is actuated, electricity is supplied to the solenoid assembly 90 causing the solenoid 96, and therefore the valve element 89, to move. The electrical system 92 may also include a flush actuator timer 98 (FIG. 3) structured to control the amount of water that passes through the system during a flush cycle.

In operation, the toilet assembly 10 works as follows. As an initial condition, the inlet valve assembly 82 is in the first closed position, and the anti-backup valve 54 is in the first closed position. In this configuration, the anti-backup valve 54 substantially prevents fluid from the passage 42 from flowing upstream into the bowl 22. Additionally, the passage 42 is substantially filled with water from a prior flush. When a user actuates the flush switch 94, the inlet valve assembly 82 moves to the second, open position allowing high pressure water into the water system 18. Water is divided into two streams at the water flow separator 84; a first stream is directed into the jet assembly pipe 86 and a second stream is directed into the bowl pipe 87. The water flowing through the jet assembly pipe 86 passes through the jet assembly passage 72 wherein the speed of the water flow is increased due to the narrowing passage 72. As the water in the first stream exits the jet assembly passage second downstream end 76, the water enters the lower portion 60, that is, below the waterline. The higher speed water entering the passage 42 creates a low pressure zone adjacent to the downstream side of the anti-backup valve 54. The pressure in the low pressure zone is sufficiently low that the pressure on the upstream side of the anti-backup valve 54 overcomes the bias maintaining the anti-backup valve 54 in the first, closed position. Thus, the anti-backup valve 54 moves to the second, open position.

At substantially the same time as the anti-backup valve 54 is being moved to the second, open position, the water in the second stream enters the bowl 22. That is, water in the second stream passes through the bowl pipe 87 and through the rim wastewater inlet 30. Water in the rim 24 is distributed about the upper edge 26 of the bowl 22 and, as the water descends into the bowl 22, substantially all of the upper surface of the bowl 22 is washed with water thereby flushing the contents of the bowl 22 through the bowl outlet 28 and into the fragmentation passage 14. Wastewater from the fragmentation passage 14 exits the toilet assembly 10 via the outlet pipe 88.

When the flush cycle is complete, the inlet valve assembly 82 moves to the first, closed position preventing high pressure water from entering into the water system 18. Accordingly, flow through the water system 18 stops and the low pressure zone created by the jet assembly 16 is dissipated. With no low pressure zone in the fragmentation passage 14, the anti-backup valve 54 is again biased to the first, closed position and the anti-backup valve 54 again substantially prevents fluid from the passage 42 from flowing upstream into the bowl 22.

Figure 4:
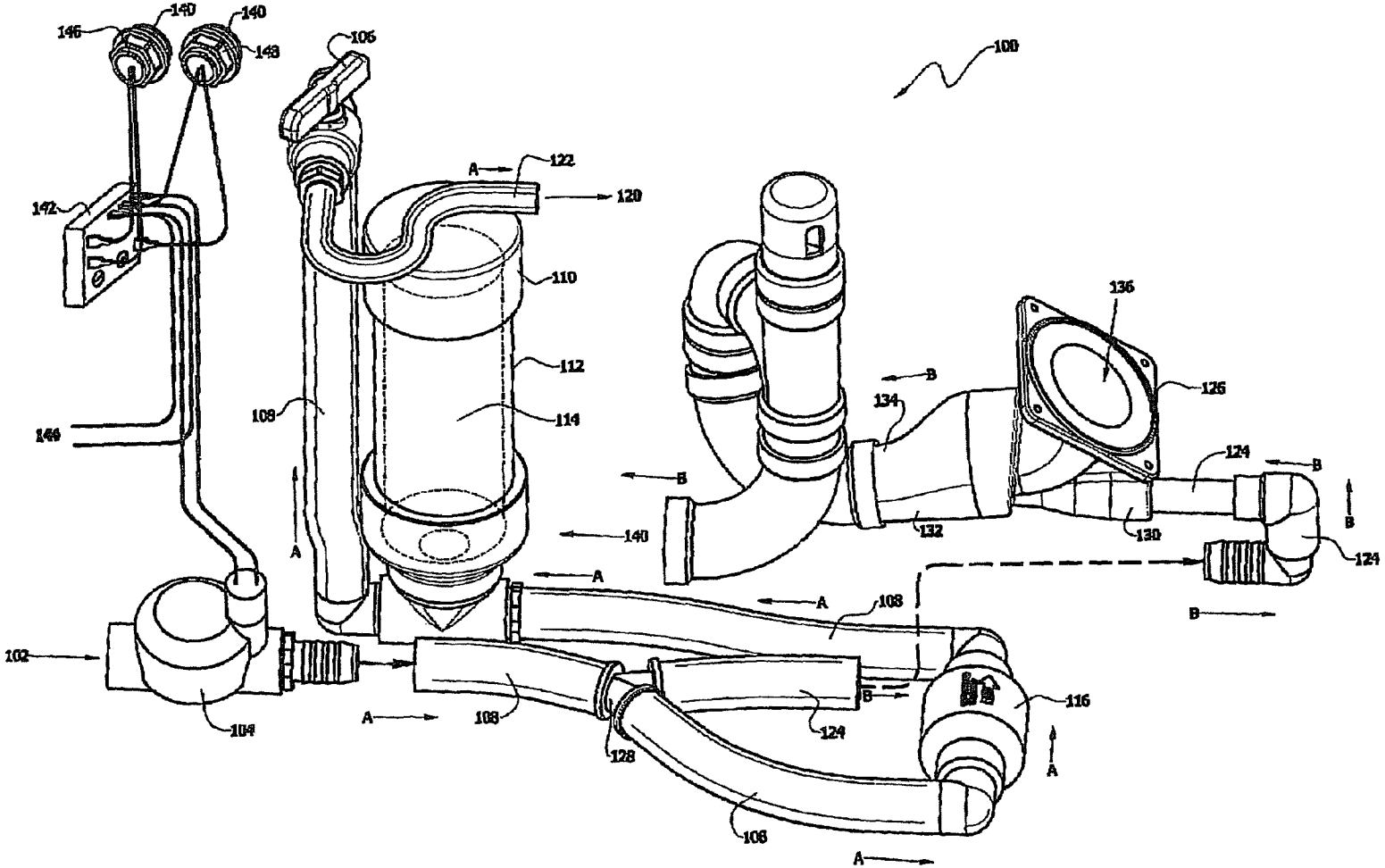
FIG. 4 is a partially exploded perspective view of an alternative embodiment of the interior components of a low volume toilet assembly of the present invention.
Figure 5:
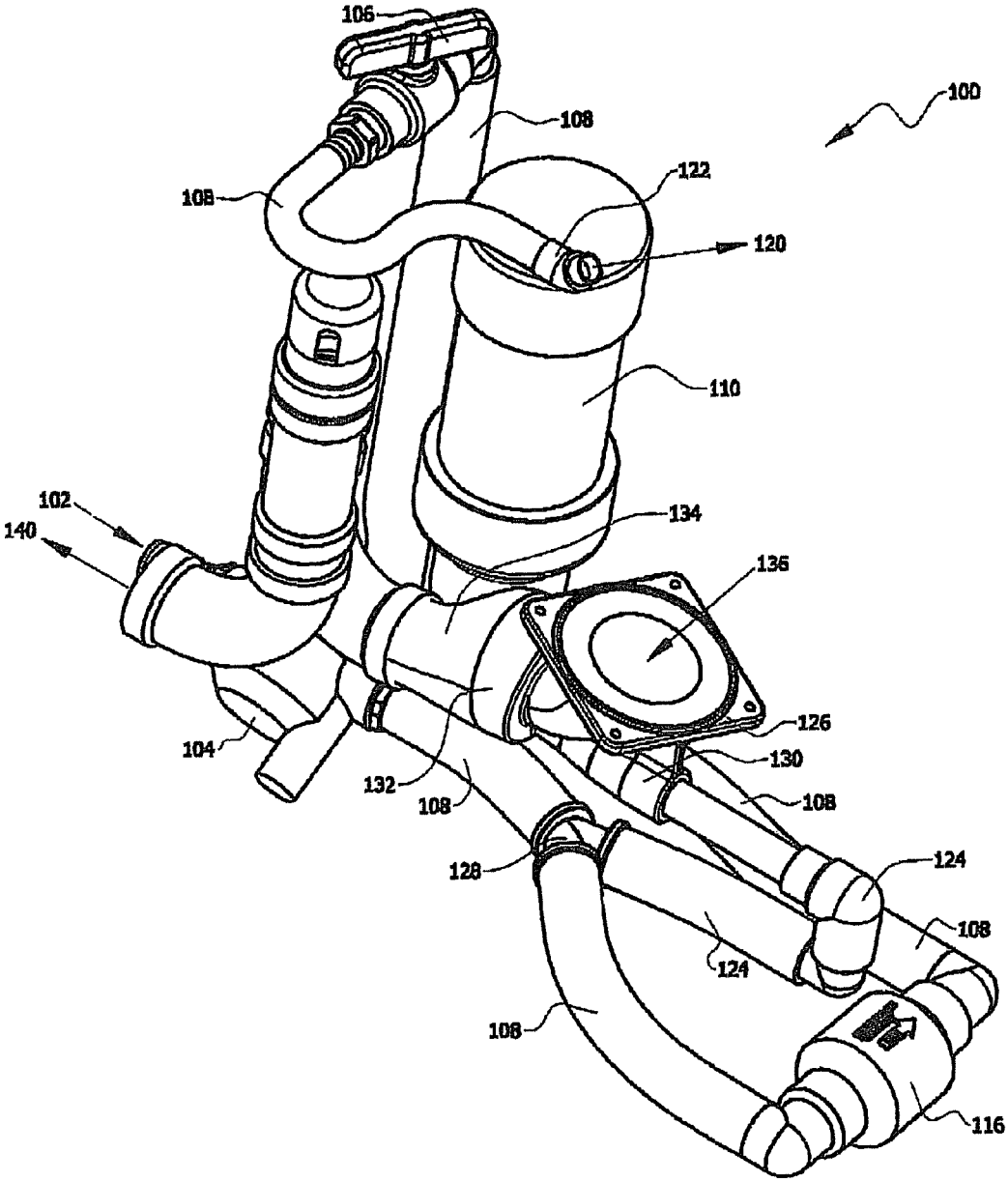
FIG. 5 is an assembled perspective view of an alternative embodiment of the interior components of a low volume toilet assembly of the present invention.

FIGS. 4-5 illustrate an alternative embodiment of the low volume toilet interior components assembly 100. The low volume toilet interior components assembly 100 includes a supply water inlet 102 including an inlet valve 104. The supply water inlet 102 may be connected to any conventional municipal water supply, as is conventionally known. The inlet valve 104 may be any suitable inlet valve, such as a needle valve, ball valve, or the like. An adjustable metering valve 106 may be provided in fluid communication with the inlet valve 104. In one embodiment, the adjustable metering valve 106 is a ball valve, a butterfly valve or other similarly adapted valve structure. The adjustable metering valve 106 may be connected to the inlet valve 104 by a piping section 108. In another embodiment, an accumulator 110 may also be provided in fluid communication with the inlet valve 104, such as provided in fluid communication with both the inlet valve 104 and the adjustable metering valve 106. The accumulator 110 may be disposed within a portion of the piping section 108, such as downstream of the inlet valve 104 and upstream of the adjustable metering valve 106. The accumulator 110 may include a housing 112 defining an interior 114 therein, adapted to allow a volume of gas to be compressed therein. The accumulator 110 may have any suitable interior 114 sized to allow an amount of compressed gas to be housed therein, sufficient to increase the force of water traveling through piping section 108, as will be described herein.

The piping section 108 may optionally include a one-way check valve 116 in fluid communication with the inlet valve 104. In one embodiment, the one-way check valve 116 may be disposed within the piping section 108 downstream of the inlet valve 104 and upstream of the accumulator 110 and/or the adjustable metering valve 106. Water may flow through the piping section 108 in the direction shown by arrows A, shown in FIG. 4, from the supply water inlet 102 to the bowl assembly inlet 120, such as a toilet rinse ring 122.

The inlet valve 104 may also be connected to a second piping section 124 provided in fluid communication with a jet assembly 126, as described above. In one embodiment, the piping section 108 and the second piping section 124 may be provided by a Y-shaped adapter 128. As described above, the jet assembly 126 may have an inlet 130 and an outlet 132. The inlet 130 may be provided in fluid communication with the inlet valve 104 though the second piping section 124, and the outlet 132 may be provided upstream of the fragmentation passage 134, also described above. As shown in FIGS. 4-5, the outlet from the bowl assembly, such as the base of the toilet bowl 136 may be provided in fluid communication with the fragmentation passage 134, such that waste deposited within the base of the toilet bowl 136 may enter the fragmentation passage 134. The fragmentation passage 134 is provided in fluid communication with a toilet outlet connected to a waste drain 140. Water may flow through the second piping section 124 in the direction shown by arrows B, shown in FIG. 4, from the supply water inlet 102 through the jet assembly 126 and into the waste drain 140.

In operation, when the inlet valve 104 is moved to an open position allowing water to pass therethough, the adjustable metering valve 106 restricts fluid flow into the bowl assembly inlet 120, such as the toilet rinse ring 122. Due to the pressure differential caused by the adjustable metering valve 106, air present in the interior 114 of the accumulator 110 is compressed, thus storing a quantity of water under pressure until the pressure differential is equalized. In one embodiment, this pressure differential is equalized when the inlet valve 104 is returned to a closed position. When the inlet valve 104 is returned to a closed position, the one-way check valve 116 disposed within the piping section 108 prevents water stored in the interior 114 of the accumulator 110 from flowing backwards through the piping system in a direction substantially opposite from the direction shown in FIG. 4 by arrows A. The one-way check valve 116 causes the water to flow through the adjustable metering valve 106 and thus into the bowl assembly inlet 120. This allows for the water level within the bowl assembly to be greater than it would otherwise be absent the storage device.

Also in operation, the accumulator 110 accounts for a two-stage flushing action. As the accumulator 110 is being charged to a system pressure, as described above, a limited amount of water is added into the bowl assembly inlet 120, thus allowing the jet assembly 126 to virtually remove all liquid material and material that is floating on or submersed in the liquid within the base of the toilet bowl 136. Once the accumulator 110 is in equilibrium with the system pressure, the water flow into the bowl assembly increases thereby moving all remaining material in the base of the toilet bowl 136 with the jet assembly 126. Due to the 2-stage flushing action, if only liquid is added to the bowl, only the first stage of the flush is require to remove all foreign debris from the base of the toilet bowl 136. This allows for a shorter flush, and requires less water to be used. In one embodiment, the shorter flush requires only about 1.5 quarts of water.

The adjustable metering valve 106 of the present embodiment serves two functions. The first is to allow the adjustment of water volume and pressure entering the bowl inlet 120. The second is that if the second piping system 124 becomes obstructed, such as downstream of the anti-backup valve described above, the adjustable metering valve 106 can be set to the fully closed position. In this configuration, when the inlet valve 104 is set to the fully open position, all water passes through the jet assembly 126, thereby pressurizing the area downstream of the anti-backup valve and removing the obstructing material from the system.

In another embodiment, the two-stage flush is achieved by two steps. During the first step, because the jet assembly 126 has a generally small opening and therefore creates resistance to the flow of water entering therethrough. Likewise, the adjustable metering valve 106 also creates resistance to the flow of water through it. Accordingly, the accumulator 110, positioned between these two restrictions in water flow, the accumulator 100 experiences water pressure significant to compress the air within the interior 114 and to store a significant amount of water under pressure. During the second step, when the air compressed in the accumulator reaches equal pressure within the system, the jet assembly and bowl assembly inlet 120 receive the full pressure during the remainder of the flush cycle. Once the flush is completed, the stored water under pressure in the accumulator 110 will flow out through the bowl assembly inlet, or rinse ring 122, due to the presence of the check valve 116, and into the bowl assembly inlet 120. Optionally, water may be delivered to the inlet of the bowl assembly 120 and the jet assembly 126 at mutually exclusive intervals.

In yet another embodiment, the duration the inlet valve 104 is open, may be determined by a switch 140, such as a sensor and/or timer 142 connected to a power supply. In certain configurations, the switch 140 may be manually operated, such that a user may select between a low volume flush 146 and a standard flush 148. In another embodiment, a plurality of switches 140, such as a plurality of sensors, may be utilized. The switch 140 may be an electrical, mechanical and/or pneumatic switch. In a further configuration, the system of the present invention may direct the quantity of water to the inlet of the bowl assembly 120 or the jet assembly 126 determined by the amount of waste present within the base of the toilet bowl 136. In a further embodiment, the low volume flush or first-stage flush may deliver about 1.5 quart of water to the system, whereas the standard flush or two-stage flush may deliver about 3 quarts of water to the system.

In a further embodiment, water may be delivered to the bowl assembly and the jet assembly in a ratio of about 2:1. In another embodiment, about 1 quart of water may be delivered to the bowl assembly and about 0.5 quart of water may be delivered to the jet assembly for a one-stage flush. In another embodiment, about 2 quarts of water may be delivered to the bowl assembly and about 1 quart of water may be delivered to the jet assembly for a two-stage flush.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A toilet assembly comprising:

a bowl assembly having an inlet and a wastewater outlet;

a water supply inlet having an inlet valve;

an adjustable metering valve in fluid communication with the inlet valve and the inlet of the bowl assembly;

an accumulator in fluid communication with the inlet valve and disposed upstream of the adjustable metering valve;

a fragmentation passage in fluid communication with the wastewater outlet and disposed downstream of the wastewater outlet; and a jet assembly having an inlet and an outlet, the inlet in fluid communication with the inlet valve and the outlet disposed upstream of the fragmentation passage, wherein the water supply inlet is structured to deliver a quantity of water through the inlet of the bowl assembly and to deliver a quantity of water to the jet assembly to remove wastewater from the fragmentation passage, and wherein the direction of the quantity of water to the bowl assembly or the let assembly is determined by the amount of waste present in the bowl assembly.

2. The toilet assembly of claim 1, wherein the adjustable metering valve is disposed downstream of the accumulator and upstream of a rinse water ring.

3. The toilet assembly of claim 1, wherein the adjustable metering valve is a ball valve.

4. The toilet assembly of claim 1, wherein when the inlet valve is moved to an open position, the adjustable metering valve restricts fluid flow into the bowl assembly.

5. The toilet assembly of claim 1, wherein the adjustable metering valve generates a pressure differential which compresses air in the accumulator.

6. The toilet assembly of claim 1, further comprising a one-way check valve in fluid communication with the inlet valve and disposed between the inlet valve and the adjustable metering valve and/or the accumulator.

7. The toilet assembly of claim 6, wherein when the inlet valve is moved to a closed position, the one-way check valve limits movement of the water stored in the accumulator and causes water to flow through the adjustable metering valve and into the bowl assembly.

8. The toilet assembly of claim 1, wherein when the adjustable metering valve is moved to a closed position, the water is directed from the inlet valve to the jet assembly without entering the adjustable metering valve.

9. The toilet assembly of claim 1, wherein the water system is structured to deliver a quantity of water to the bowl assembly and to deliver a quantity of water to the jet assembly at mutually exclusive intervals.

10. The toilet assembly of claim 9, wherein the water system is directed to deliver a quantity of water to either the bowl assembly or the jet assembly by a switch.

11. The toilet assembly of claim 1, wherein the water system delivers about 1 quart of water to the bowl assembly and about 0.5 quart of water to the jet assembly for a one-stage flush.

12. The toilet assembly of claim 1, wherein the water system delivers about 2 quarts of water to the bowl assembly and about 1 quart of water to the jet assembly for a two-stage flush.

13. The toilet assembly of claim 1, wherein the water system delivers water to the bowl assembly and the jet assembly by a ratio of 2:1.

14. The toilet assembly of claim 1, further comprising a switch to control the length of time the inlet valve is in an open position.

15. The toilet assembly of claim 14, wherein the switch is an electrical, mechanical or pneumatic switch.

16. The toilet assembly of claim 14, wherein the switch is a manual switch and the length of time the inlet valve is in the open position is controlled solely by an operator.

17. A method of generating a two-stage flushing action, comprising the steps of:

providing a toilet assembly comprising:

a bowl assembly having an inlet and a wastewater outlet, a water supply inlet having an inlet valve, an adjustable metering valve in fluid communication with the inlet valve and the inlet of the bowl assembly, an accumulator in fluid communication with the inlet valve and disposed upstream of the adjustable metering valve, a fragmentation passage in fluid communication with the wastewater outlet and disposed downstream of the wastewater outlet, and a jet assembly having an inlet and an outlet, the inlet in fluid communication with the inlet valve and the outlet disposed upstream of the fragmentation passage, wherein the water supply inlet is structured to deliver a quantity of water through the inlet of the bowl assembly and to deliver a quantity of water to the jet assembly to remove wastewater from the fragmentation passage; and selectively directing a quantity of water to the inlet of the bowl assembly or to the jet assembly based on the amount of waste present in the bowl assembly.

18. The method of generating a two-stage flushing action of claim 17, wherein the water system delivers about 1 quart of water to the bowl assembly, and about 3 quarts of water to the jet assembly.

19. A toilet assembly comprising:

a bowl assembly having an inlet and a wastewater outlet;

a water supply inlet having an inlet valve;

an adjustable metering valve in fluid communication with the inlet valve and the inlet of the bowl assembly;

an accumulator in fluid communication with the inlet valve and disposed upstream of the adjustable metering valve;

a fragmentation passage in fluid communication with the wastewater outlet and disposed downstream of the wastewater outlet; and a jet assembly having an inlet and an outlet, the inlet in fluid communication with the inlet valve and the outlet disposed upstream of the fragmentation passage, wherein the water supply inlet is structured to deliver a quantity of water through the inlet of the bowl assembly and to deliver a quantity of water to the jet assembly to remove wastewater from the fragmentation passage, and wherein when the adjustable metering valve is moved to a closed position, the water is directed from the inlet valve to the jet assembly without entering the adjustable metering valve.

20. A toilet assembly comprising:

a bowl assembly having an inlet and a wastewater outlet;

a water supply inlet having an inlet valve;

an adjustable metering valve in fluid communication with the inlet valve and the inlet of the bowl assembly;

an accumulator in fluid communication with the inlet valve and disposed upstream of the adjustable metering valve;

a fragmentation passage in fluid communication with the wastewater outlet and disposed downstream of the wastewater outlet; and a jet assembly having an inlet and an outlet, the inlet in fluid communication with the inlet valve and the outlet disposed upstream of the fragmentation passage, wherein the water supply inlet is structured to deliver a quantity of water through the inlet of the bowl assembly and to deliver a quantity of water to the jet assembly to remove wastewater from the fragmentation passage, and wherein the water system is structured to deliver a quantity of water to the bowl assembly and to deliver a quantity of water to the jet assembly at mutually exclusive intervals.

* * * * *